United States Patent [19]

Murphy et al.

[11] Patent Number: 4,856,568

[45] Date of Patent: Aug. 15, 1989

[54] FUNNEL APPARATUS

[76] Inventors: Jimmy D. Murphy, 622 E. Rosewood; Ted Hicks, 437 N. Main, both of Republic, Mo. 65738

[21] Appl. No.: 115,042

[22] Filed: Oct. 30, 1987

[51] Int. Cl.[4] ..... B67C 11/00; B65B 39/02

[52] U.S. Cl. ..... 141/337; 141/98; 141/340; 141/382; 141/386; 220/85 F; 220/85 SP; 220/86 R

[58] Field of Search ..... 141/98, 331–344, 141/382–386, 387; 220/85 R, 85 F, 85 SP, 86 R; 184/105.1, 1.5

[56] References Cited

U.S. PATENT DOCUMENTS

| | | | |
|---|---|---|---|
| D. 241,597 | 9/1976 | Confer et al. | 141/336 X |
| 1,712,592 | 5/1929 | Tomlinson | 141/98 X |
| 2,578,184 | 12/1951 | Green | 220/86 R |
| 2,811,181 | 10/1957 | Correl | 141/340 |
| 4,338,983 | 7/1982 | Hatcher | 141/331 |
| 4,559,984 | 12/1985 | Wycech | 141/340 |
| 4,600,125 | 7/1986 | Maynard, Jr. | 141/331 X |
| 4,703,867 | 11/1987 | Schoenhard | 220/85 F |

FOREIGN PATENT DOCUMENTS

| | | | |
|---|---|---|---|
| 8604318 | 7/1986 | PCT Int'l Appl. | 141/332 |
| 758015 | 9/1956 | United Kingdom | 141/331 |
| 2081129 | 2/1982 | United Kingdom | 141/331 |

*Primary Examiner*—Ernest G. Cusick

*Attorney, Agent, or Firm*—Richard C. Litman

[57] ABSTRACT

A funnel apparatus includes a fluid receiver section joined to an elongated flexible extension. Carried by the lower portion of the extension is a hollow cap fastener member having a cylindrical portion joined to a lower tapered portion. External threads on the entire periphery of the cap fastener member firmly engage the straight wall forming a cavity within an adapter cap having a flat bottom provided with a central opening. Threading of the fastener member into the adapter cap cavity maintains the abutment of its bottom with the fastener member bottom to insure a positive connection of the components as fluid is poured therethrough into a filler opening such as an automotive oil or water opening.

1 Claim, 8 Drawing Sheets

FUNNEL APPARATUS

FIELD OF INVENTION

Devices for funneling fluids are simple, practical and nearly indispensable for neatly and cleanly filling an engine with necessary fluids such as water and oil. The present invention relates to funnels and to a construction of a funnel enabling the user to secure the funnel to the inlet port for fluids and further to adapt the device to a variety of different engine configurations and lengths of funnel engagement.

BACKGROUND TO THE INVENTION

This device relates to funnels and, more particularly to funnel apparatuses having means for adapting to a plurality of applications, both in the 'reach' of the funnel as in hard to get at places of an engine cowling, and also in adapting the funnel apparatus to different sizes of diameter filing holes.

The radiator has a certain size opening as does the oil filler hole in the engine block. Traditionally, one of the biggest problems with conventional funnels is the necessity to hold the funnel end within the orifice while fluids are pouring through. This often results in spilled oil or water or other fluids such as brake fluid or windshield washing fluids in the dispenser.

The present apparatus relates to those funnel devices for having a means for helping the user work 'hands free.' The funnel apparatus as it secures into a variety of different sized openings, is stabilized within these varying sized filler openings. The result is that the conveying of fluids is done neatly, without spilling.

DESCRIPTION OF THE PRIOR ART

The following cited references are found to be exemplary of the prior art. They are:

| U.S. Pat. No. | Inventor |
|---|---|
| 2,940,303 | M. J. Enell |
| 4,338,983 | Hatcher |
| 4,600,125 | Maynard, Jr. |

U.S. Pat. No. 2,940,303, issued to M. J. Enell, discloses a radiator cap testing device. This invention is a pressure testing device for automobile radiators. It is affixed to the radiator where the radiator cap is placed, and the system is pressurized and test.

U.S. Pat. No. 4,338,983, to Hatcher, teaches the construction of an oil cap with self-contained funnel. This invention consists of an oil cap that is secured to the valve cover for the purpose of adding oil to the engine. An opening in the cap receives a next portion that extends upwardly and in turn receives a funnel.

U.S. Pat. No. 4,600,125, issued to Maynard, Jr. closes a Liquid Funnel and Pouring Spout Combination. This device provides a versatile pouring system for containerized liquids. It includes a container seating and a built-in can piercing element. Also featured is a detachable extension and closure plug.

The above cited references, whether taken singly or in combination do not disclose the specific features of the present invention in any way so as to bear upon the claims as appended hereto.

BRIEF DESCRIPTION OF THE DRAWING

FIG. 1(E) is a perspective view of the oil adapter as affixed to the funnel extension.

FIG. 1(F) is a perspective view of the fluid receiver and funnel extension with the joined or affixed fluid receiver seated within the uppermost rung of the funnel extension element.

DESCRIPTION OF THE PREFERRED EMBODIMENT

Figure 1:
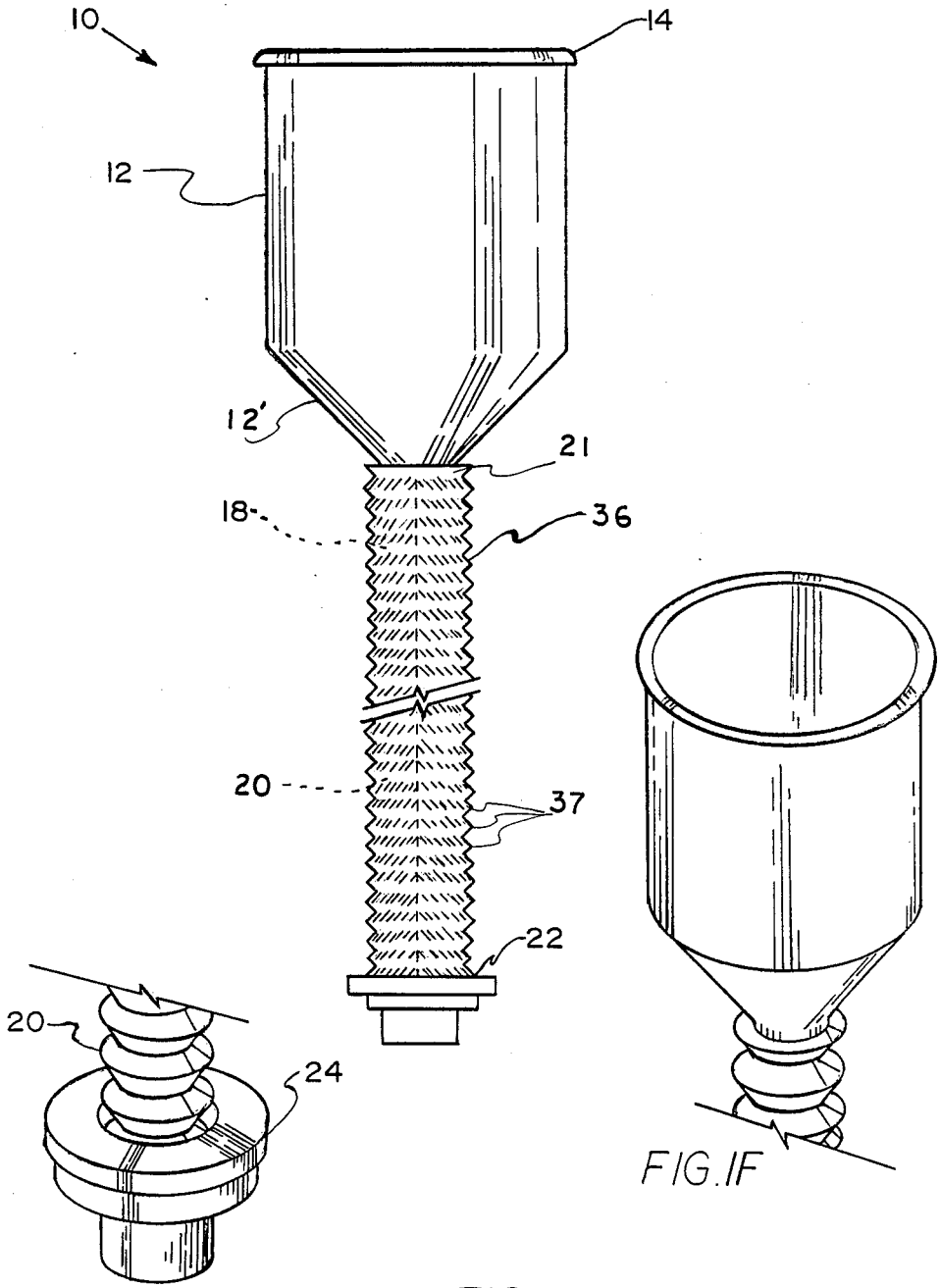
FIG. 1 is an elevational view of the device illustrating a receiving member and a tubular extension having a pliable fitting adapter cap for the pouring of oil.

Referring now to the figures in which like numerals refer to like elements throughout, FIG. 1 shows the funnel apparatus 10 as including a receiving member 12 that has an outwardly angled flange 14 peripherally deployed on the upper reaches thereof.

Flange 14 provides a lifting surface for the user, a grip that extends around the funnel apparatus enabling a firm hold. Receiving member 12 has a lower portion 12' that has a configuration of a truncated cone with an orifice 16 substantially centered therein and a tubular extension 18 integral therewith as shown in FIG. no. 2.

Figure 3:
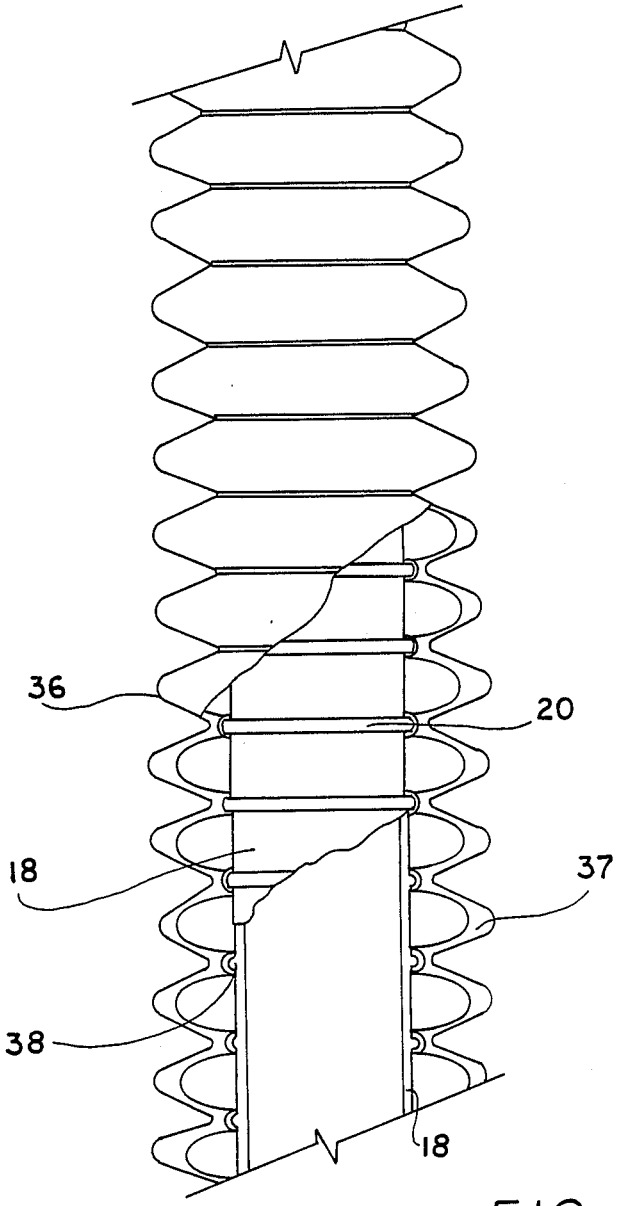
FIG. 3 is a cutaway view of the funnel extension and illustrates the snap/lock structure of each rung within the funnel extension. The snap/lock structure allowing an outer funnel element to be snapably telescoped over an inner funnel element.
Figure 3A:
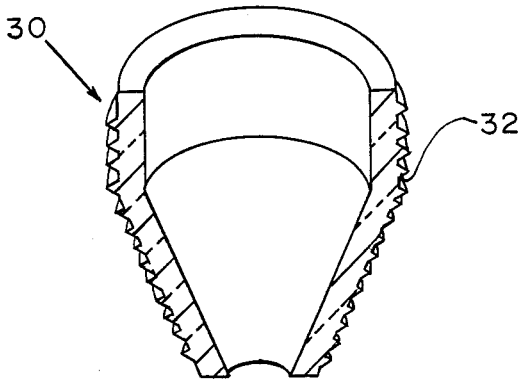
FIG. 3(A) is a cutaway view of an alternative end cap fastening means that illustrates a threaded exterior for urging or biasing the end cap into a filling orifice in an engine block.
Figure 3B:
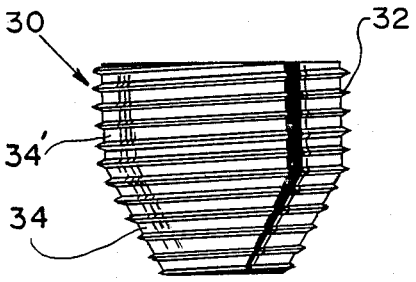
FIG. 3(B) is an elevational view of the alternative end cap element that illustrates how the device, due to its tapering exterior fits progressively into larger orifices to accommodate any different sized filling hole.

Tubular inner extension 18 has a plurality of radially interlocking elements 20, comprising snap-lock ribs, as indicated in FIG. 3 that provide for flexibility of the tubular extension 18. Interlocking elements 20 are constructed of any suitable material such as plastics. Extension 18 having two ends, an uppermost end 21, rigidly attached to receiving member 12 and a lowermost end 22.

Overlay member 36 is constructed of similar corrugated elements as is tubular extension 18 and comprises a second length of these radially deployed elements 37 that overlay and contain tubular extension 18. Adapter cap 30 affixes to the lowermost end 36' of the overlay element 22.

The bulbous extension 38 as formed by each element 20 will be seen to provide an engagement with the elements 37 of the outermost member 36 such that both inner and outer members 18,36 may be bent or deflected, in view of their flexible construction, to accommodate variable automotive configurations.

Figure 1A:
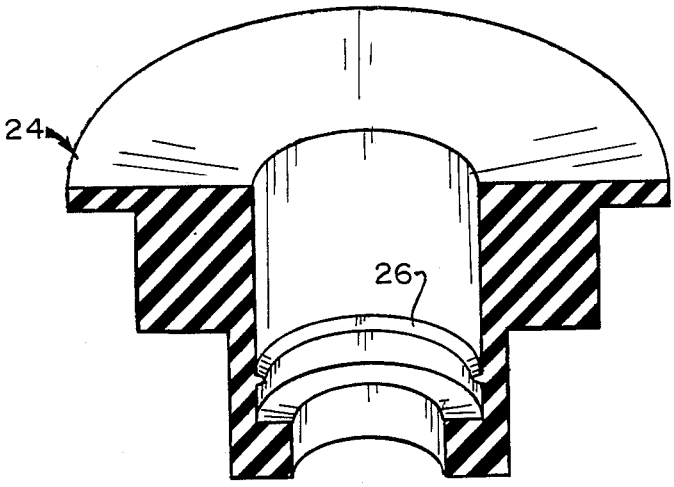
FIG. 1(A) is a detail drawing in sectional view of the oil cap adapter and shows an internally deployed securing means for affixing the adapter cap to a funnel extension.
Figure 1B:
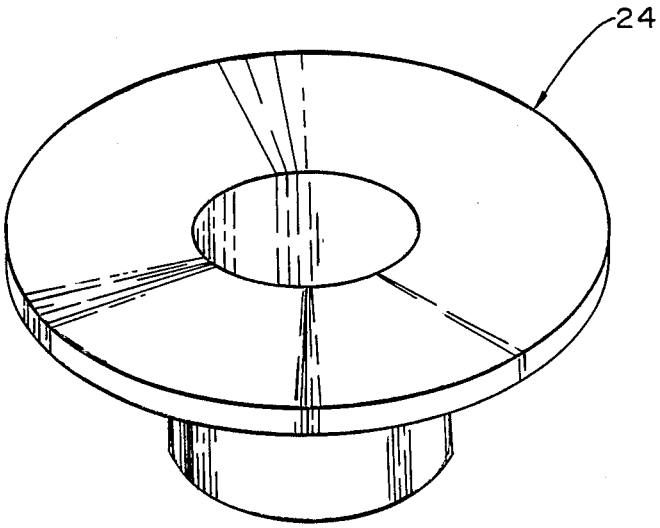
FIG. 1(B) is a perspective view of the oil cap adapter.
Figure 1C:
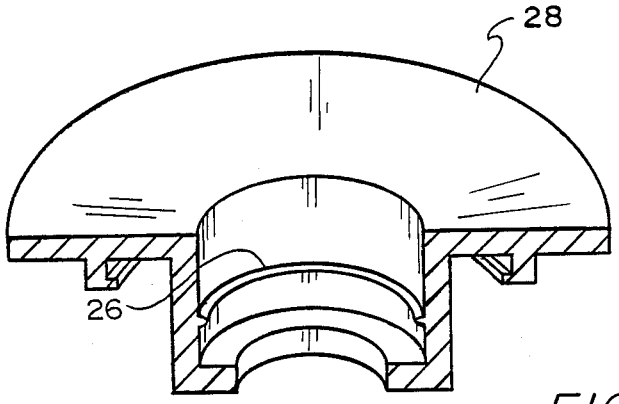
FIG. 1(c) is a sectional view of a radiator adapter that shows means for securing the adapter element into the radiator receptacle.
Figure 1D:
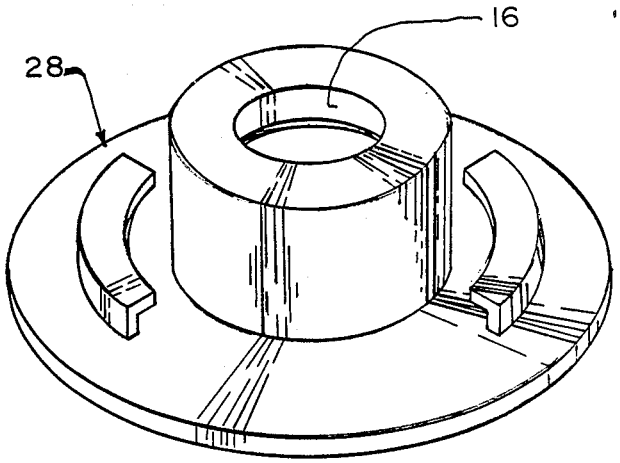
FIG. 1(D) is a reverse perspective view of the radiator adapter illustrating the securing means.
Figure 2:
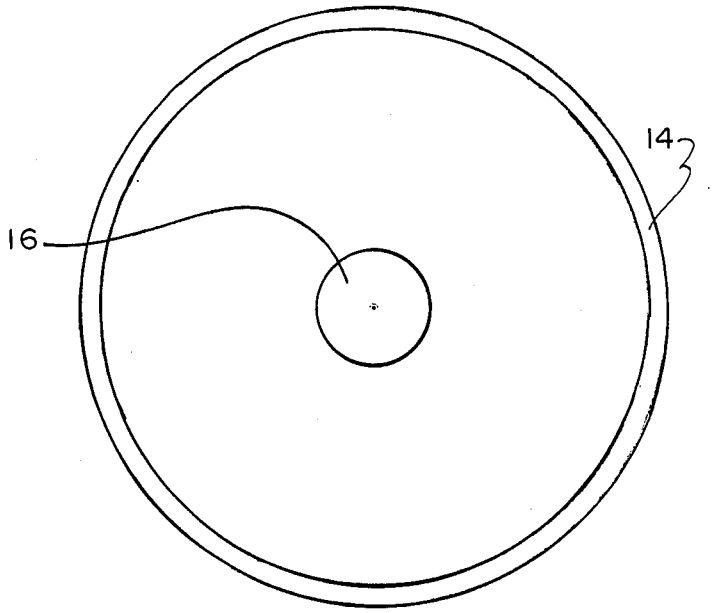
FIG. 2 is a top or plan view of the device that illustrates the outer rung, or grip element.

Oil fill cap 24 is constructed of any suitable pliable material such as rubber and is sized to fit within a fill orifice of an oil fill opening on an engine. Oil fill cap 24 has a recess 26, as shown in FIG. 1(A) peripherally deployed internally that allows adapter cap 24 to snap onto end 22 of tubular extension member 18. Conversely, oil cap 24 may be removed and water fill cap 28 may be snapably inserted over extension member 18 for the subsequent filling of a radiator.

Alternatively, adapter or end cap fastener means 30 is permanently mounted onto end 22 of tubular extension member 18 and includes an upper cylindrical portion 34' attached to the tubular extension 18 and a lower tapered portion 34.

Figure 3C:
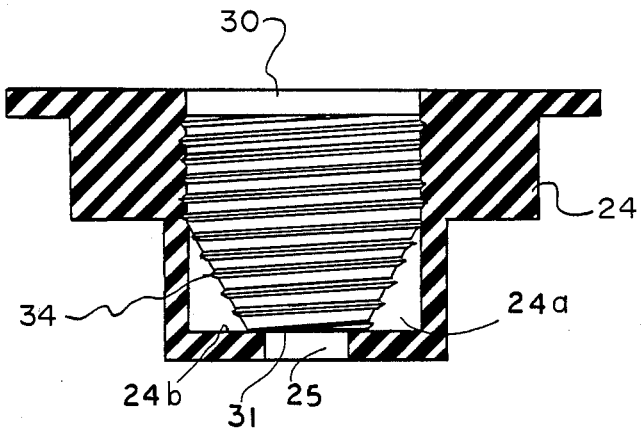
FIG. 3(C) is a sectional view of the alternative end cap element having a oil fill cap member mounted thereon.
Figure 3D:
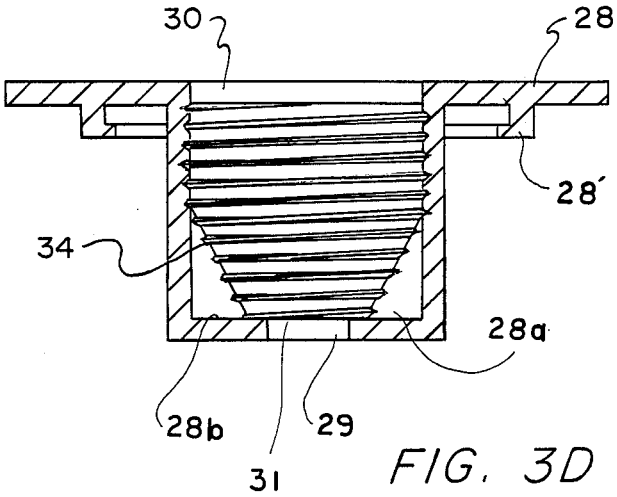
FIG. 3(D) is a sectional view of the alternative end cap element having a radiator cap member mounted on it.

Referring to FIGS. 3C and 3D, both adapters 24,28 include a central cavity **24*a*,28*a* and a bottom, reduced diameter opening 25,29, respectively, for passing the applicable fluid and the radiator adapter 28 will be seen to include flanged, locking segments 28' engageable with the filler opening (not shown) of a radiator. In each instance, the bottom 31 of the cap 30 is of greater diameter than that of the adpater cap opening 25 or 29. This construction allows a positive abutment between the flat cap bottom 31 and the flat bottom 24*b* or 28*b*** of the respective.

Figure 4:
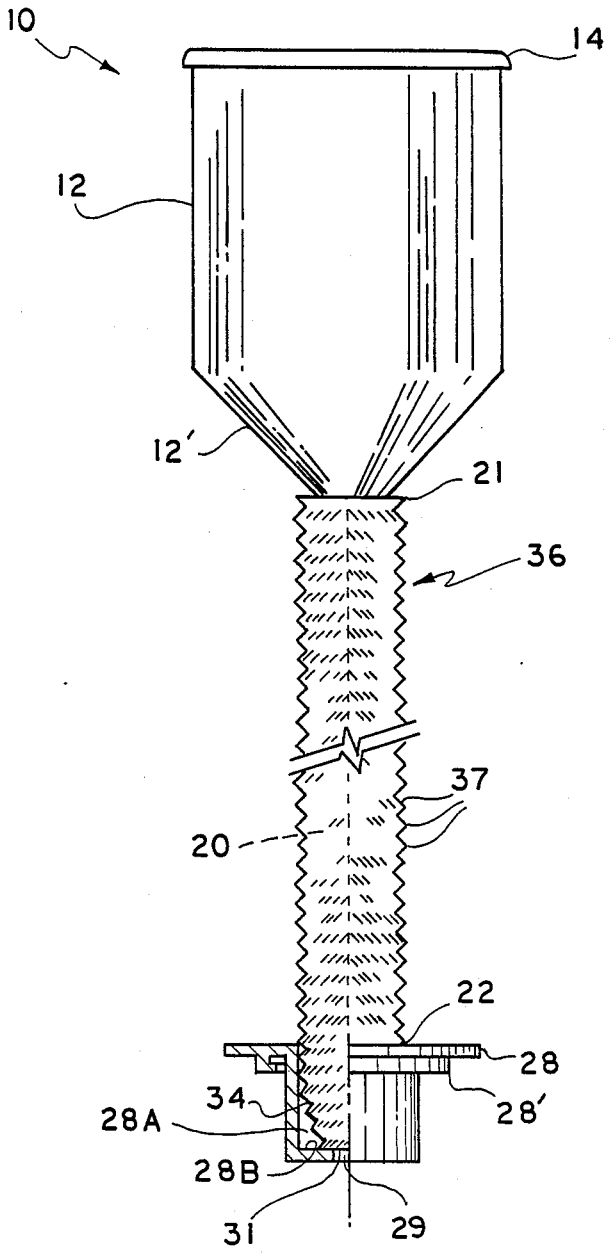
FIG. 4 is a view, partly in cross-section, illustrating the combination of receiving member and extension member attached to cap fastening means and adapter cap.

FIG. 4 illustrates the adapter of FIG. 3D, described above, in combination with the fluid receiver member 12 and extension member 18. This is for illustrative purposes only since both adapter caps 24 (FIG. 3C) and 28 (FIG. 3D) are usable with adapter or end cap fastening means 30.

Hollow adapter cap 30 has securing means 32, such as externally deployed threads 32 to enable a user to use the funnel apparatus with or without oil and water caps 24 and 28. The funnel apparatus 10 is inserted into a water or oil filling orifice and rotated so as to bias or urge securing means 32 against the perimeter of the orifice; the conical, hexically threaded pattern functioning to wedge the funnel apparatus into the orifice and thereby keep the device stationary as fluids flow through the device. Adapter caps 24 and 28 may also be deployed directly over adapter cap 30 as in any application where a tighter pressures seal is to be maintained.

The foregoing is considered illustrative only of the principles of the invention. Further, since numerous modifications and changes will readily occur to those skilled in the art, it is not desired to limit the invention to the exact construction and operation shown and described, and accordingly, all suitable modifications and equivalents that may be resorted to, fall within the scope of the invention.

What is claimed is:

1. A funnel apparatus comprising:

a cylindrical fluid receiving member having a bottom orifice;

a flexible, elongated extension member having an uppermost end attached to said receiving member adjacent said bottom orifice and having a lowermost end;

cap fastening means on said extension member lowermost end;

said cap fastening means including a hollow member having an upper vertically walled cylindrical portion and a lower tapered portion terminating in a bottom; securing means on said hollow member upper and lower portions;

an adapter cap adapted to engage within a fluid-receiving opening; said adapter cap comprising a cylindrical member having a cylindrical vertically walled interior cavity bounded by a flat bottom having a central bottom opening; said bottom opening having a diameter less than that of said cap fastening means bottom;

said cap fastening means inserted within said adapter cap cavity with at least a portion of said securing means engaging said adapter cap; said securing means allowing for removable engagement of the cap fastening means and adapter cap and said cap fastening means bottom abutting said adapter cap flat bottom, whereby said adapter cap central bottom opening is disposed flat relative said cap fastening means bottom in a concentric manner relative said bottom opening.

* * * * *